US009843136B1

(12) United States Patent
Lin et al.

(10) Patent No.: US 9,843,136 B1
(45) Date of Patent: Dec. 12, 2017

(54) ELECTRICAL SOCKET CONNECTOR

(71) Applicant: SHENZHEN DEREN ELECTRONIC CO., LTD., Shenzhen (CN)

(72) Inventors: Zongbiao Lin, Shenzhen (CN); Zhudong Huo, Shenzhen (CN)

(73) Assignee: SHENZHEN DEREN ELECTRONIC CO., LTD., Shenzhen (CN)

( * ) Notice: Subject to any disclaimer, the term of this patent is extended or adjusted under 35 U.S.C. 154(b) by 0 days.

(21) Appl. No.: 15/625,308

(22) Filed: Jun. 16, 2017

(30) Foreign Application Priority Data

Nov. 22, 2016 (CN) ..... 2016 2 1269483 U

(51) Int. Cl.

| | |
|---|---|
| ***H01R 13/6474*** | (2011.01) |
| ***H01R 13/6585*** | (2011.01) |
| ***H01R 13/42*** | (2006.01) |
| ***H01R 12/71*** | (2011.01) |
| ***H01R 12/58*** | (2011.01) |
| ***H01R 13/6476*** | (2011.01) |

(52) U.S. Cl.
CPC ..... *H01R 13/6474* (2013.01); *H01R 12/58* (2013.01); *H01R 12/712* (2013.01); *H01R 13/42* (2013.01); *H01R 13/6476* (2013.01); *H01R 13/6585* (2013.01)

(58) Field of Classification Search
CPC ..... H01R 13/6476; H01R 13/6474
See application file for complete search history.

(56) References Cited

U.S. PATENT DOCUMENTS

| | | | | |
|---|---|---|---|---|
| 8,011,966 | B1 * | 9/2011 | Tang | H01R 13/6461 439/638 |
| 9,742,121 | B2 * | 8/2017 | Hayashi | H01R 13/6585 |
| 2011/0021088 | A1 * | 1/2011 | Chen | H01R 23/688 439/732 |
| 2016/0099526 | A1 * | 4/2016 | Chen | H01R 13/5045 439/607.05 |
| 2017/0040747 | A1 * | 2/2017 | Hayashi | H01R 13/6585 |

* cited by examiner

*Primary Examiner* — James Harvey
(74) *Attorney, Agent, or Firm* — Ladas & Parry LLP

(57) ABSTRACT

An electrical socket connector includes: an insulation body, first terminals, second terminals, and a metal casing. The insulation body includes a basal part and a tongue plate connected to the basal part. The first terminals each include a first contact part and the second terminals each include a second contact part. Each first contact part comprises a first front contact part and a first rear contact part. Each second contact part comprises a second front contact part and a second rear contact part. The tongue plate defines first and second recesses. Each first recess is positioned between two adjacent first front contact parts. Each second recess is positioned between two adjacent second rear contact parts.

10 Claims, 5 Drawing Sheets

ELECTRICAL SOCKET CONNECTOR

The present disclosure claims priority to Chinese Patent Application No. 201621269483.6, filed with the Chinese Patent Office on Nov. 22, 2016, titled "ELECTRICAL SOCKET CONNECTOR," the entire contents of which are incorporated herein by reference.

TECHNICAL FIELD

The present disclosure relates to the field of a connector, and particularly, to an electrical socket connector.

BACKGROUND

With the continuous innovation of technologies with regard to connectors, the development of the connectors has exhibited the following characteristics: the high speed and digitization of signal transmission, the integration of all kinds of signal transmission, the miniaturization of product volume, and the like. Upon designing a high speed connector, the stability and integrity of the signals are key points throughout the design process. In a high speed system, a differential signal connector is often employed; when high speed signals pass through the connector, there is huge crosstalk between signals, so, it is required to implement signal isolation.

SUMMARY

An embodiment of the present disclosure provides an electrical socket connector. The electrical socket connector includes: an insulation body, first terminals, second terminals, and a first metal casing. The insulation body includes a basal part and a tongue plate connected to the basal part, and the tongue plate includes a first surface and a second surface opposite to each other. The first terminals each includes a first contact part, the second terminals each includes a second contact part, the first contact part is positioned on the first surface of the tongue plate, the second contact part is fixed on the second surface of the tongue plate, and center lines of some of the first contact parts and some of the second contact parts are vertically aligned with each other, wherein, each first contact part includes a first front contact part and a first rear contact part, each second contact part includes a second front contact part and a second rear contact part, a width of the first front contact part is less than a width of the first rear contact part, and a width of the second rear contact part is less than a width of the second front contact part;

the tongue plate defines first recesses, each first recess is positioned between two adjacent first front contact parts, and each of the second front contact parts is exposed to two adjacent first recesses; and the tongue plate defines second recesses, each second recess is positioned between two adjacent second rear contact parts, and each of the first rear contact parts is exposed to two adjacent second recesses.

BRIEF DESCRIPTION OF THE DRAWINGS

One or more embodiments are illustrated by way of example, and not by limitation, in the figures of the accompanying drawings, wherein elements having the same reference numeral designations represent like elements throughout. The drawings are not to scale, unless otherwise disclosed.

DETAILED DESCRIPTION

For better understanding of the present disclosure, the present disclosure is described in detail with reference to attached drawings and embodiments. It should be noted that, when an element is described as "being connected to" or "being fixed to" another, the two elements are directly connected/fixed or the two elements are indirectly connected/fixed with one or more intermediate elements included there between. The terms "vertical", "horizontal", "left", and "right" and the like are intended to describe and not to limit the disclosure.

Unless otherwise defined, all of the technical and scientific terms used in this specification are commonly understood by those skilled in the art. In this specification, the terms are used only for the purpose of describing particular embodiments, and not intended to limit the disclosure. The term "and/or" as used in this specification includes any one or more of the associated listed items and all combinations thereof.

Figure 1:
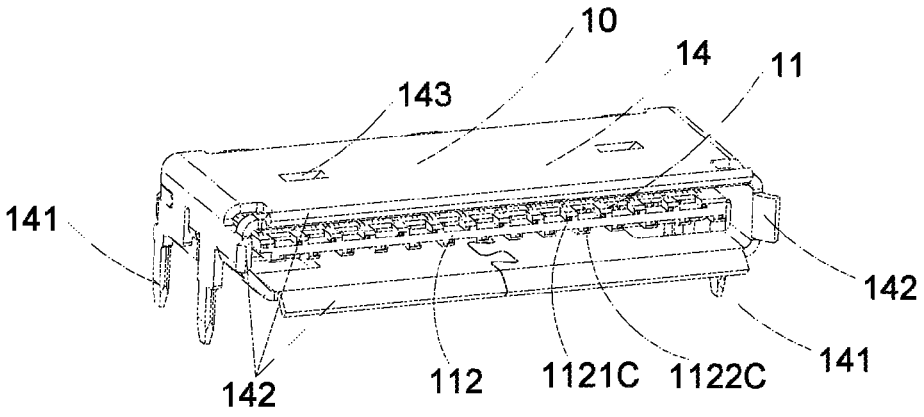
FIG. 1 is a stereogram of an electrical socket connector in accordance with an embodiment of the present disclosure.
Figure 2:
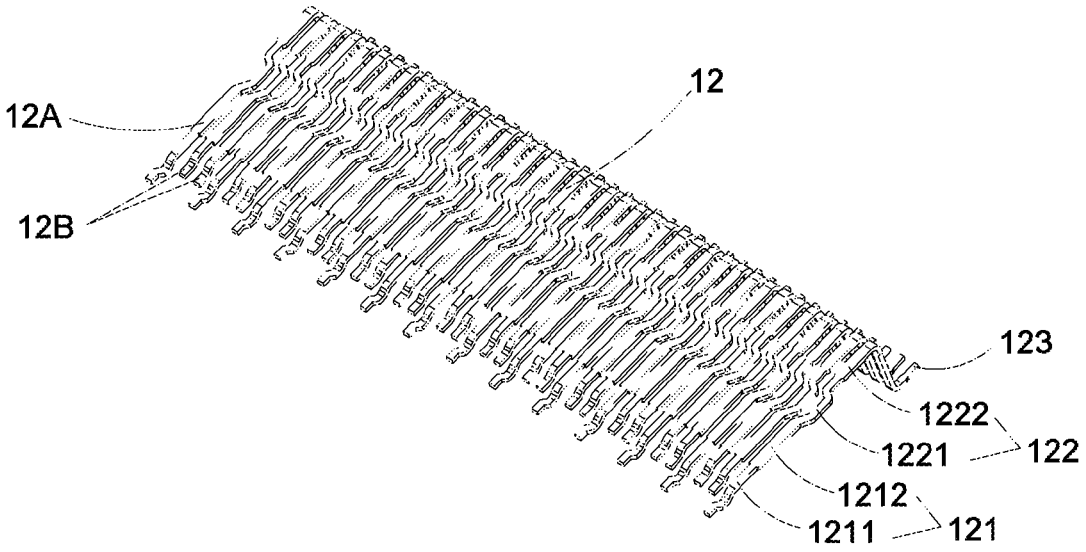
FIG. 2 is a schematic diagram of first terminals of the electrical socket connector of FIG. 1.
Figure 3:
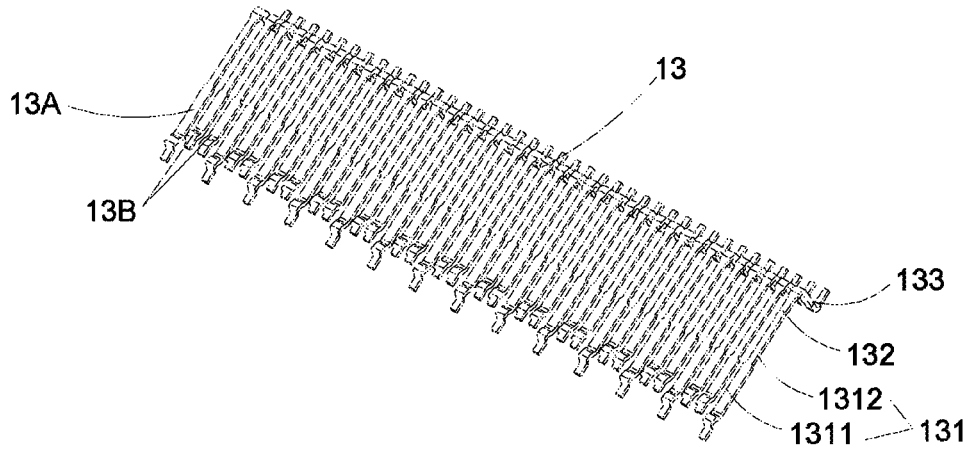
FIG. 3 is a schematic diagram of second terminals of the electrical socket connector of FIG. 1.

As shown in FIGS. 1-5, FIG. 1 is a stereogram of an electrical socket connector in accordance with an embodiment of the present disclosure, FIG. 2 is a schematic diagram of first terminals of the electrical socket connector of the embodiment of the present disclosure, and FIG. 3 is a schematic diagram of second terminals of the electrical socket connector of the embodiment of the present disclosure. The electrical socket connector 10 of the embodiment of the present disclosure includes: an insulation body 11, first terminals 12, second terminals 13, and a metal casing 14. The first terminals 12, the second terminals 13, and the insulation body 11 are integrated by one-step embedding.

Figure 4:
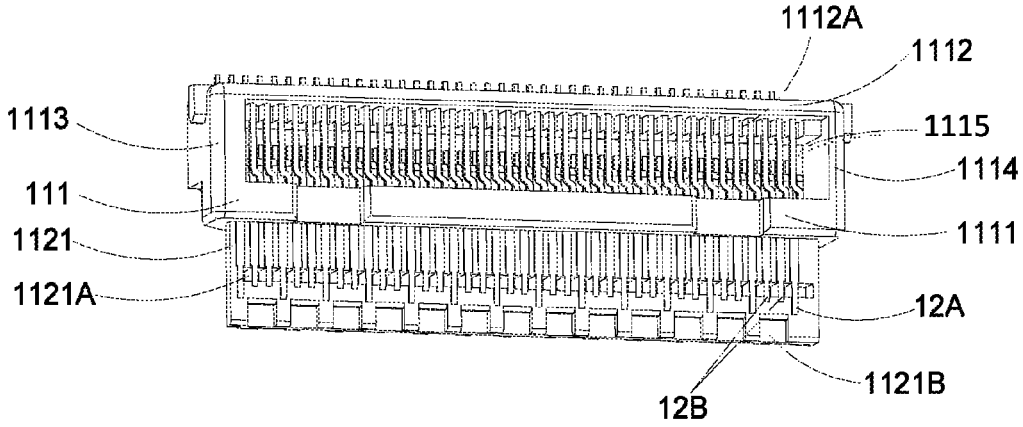
FIG. 4 is an assembling view of an insulation body, the first terminals and the second terminals of the electrical socket connector of FIG. 1.
Figure 5:
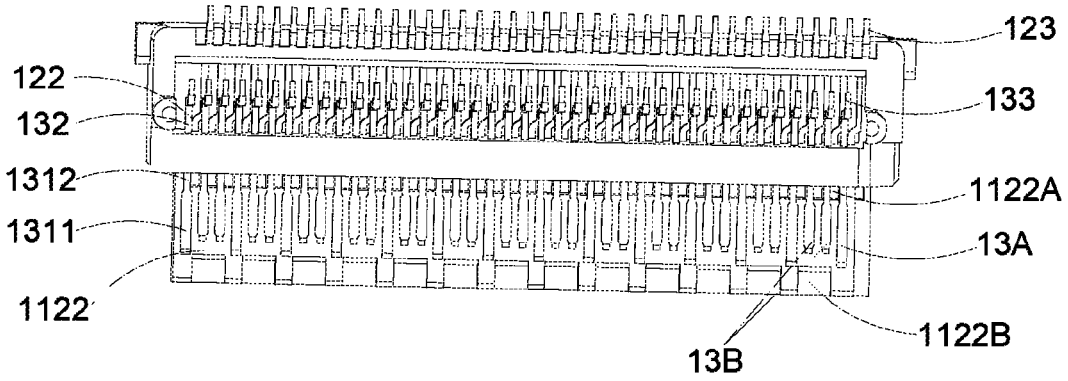
FIG. 5 is another assembling view of the insulation body, the first terminals and the second terminals of the electrical socket connector of FIG. 1, but viewed from another angle.

The insulation body 11 includes a basal part 111 and a tongue plate 112 extending from the basal part 111. The tongue plate 112 includes a first surface 1121 and a second surface 1122 opposite to each other. The first terminals 12 each includes a first contact part 121, a first connection part 122 and a first welding part 123. The second terminals 13 each includes a second contact part 131, a second connection part 132 and a second welding part 133. The first contact part 121 is fixed on the first surface 1121 of the tongue plate 112, the second contact part 131 is fixed on the second surface 1122 of the tongue plate 112. The first connection part 122 and the second connection part 132 are fixed on the basal part 111, and the first welding part 123 and the second welding part 133 extend out of the insulation body 11. The center lines of some of the first contact parts 121 and some of the second contact parts 131 are vertically coincident; specifically, the center lines of some of the first contact parts 121 and the second contact parts 131 are vertically aligned. In the embodiment, the first contact parts 121 and the second contact parts 131 are mutually staggered by one contact part from left to right. As shown in FIGS. 4 and 5, there is no second contact part 131 below the left-most first contact part 121, and there is no first contact part 121 above the right-most second contact part 131.

Each first contact part 121 includes a first front contact part 1211 and a first rear contact part 1212, each second contact part 131 includes a second front contact part 1311 and a second rear contact part 1312, a width of the first front contact part 1211 is less than a width of the first rear contact part 1212, and a width of the second rear contact part 1312 is less than a width of the second front contact part 1311.

Figure 6:
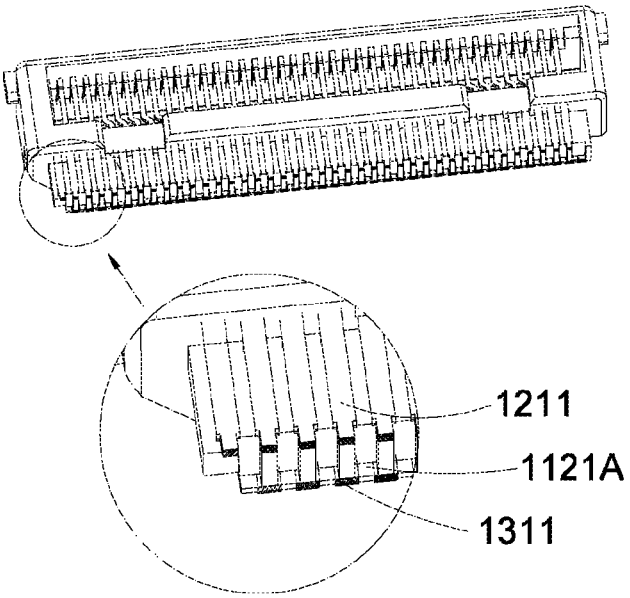
FIG. 6 is a partial enlarged view of the electrical socket connector of FIG. 1.

The tongue plate 112 defines first recesses 1121A. Each first recess 1121A is positioned between two adjacent first front contact parts 1211, and each second front contact part 1311 is exposed to two adjacent first recesses 1121A, specifically, the noncontact surfaces of each second front contact part 1311 are exposed to two adjacent first recesses 1121A, as shown in FIG. 6, which facilitates the fixation of the second terminals 13 in the process of injection molding.

Figure 7:
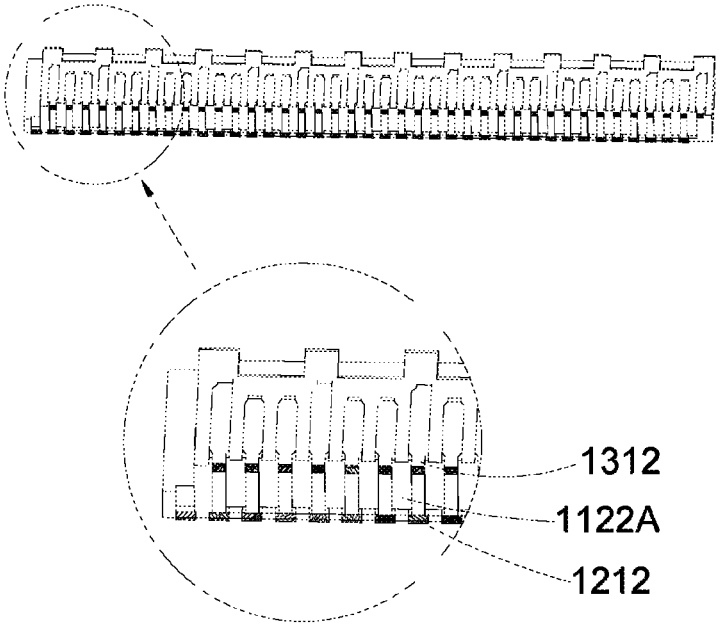
FIG. 7 is another partial enlarged view of the electrical socket connector of FIG. 1.

The tongue plate 112 defines second recesses 1122A. Each second recess 1122A is positioned between two adjacent second rear contact parts 1312, and each first rear contact part 1212 is exposed to two adjacent second recesses 1122A, specifically, the noncontact surfaces of the first rear contact part 1212 are exposed to two adjacent second recesses 1122A, as shown in FIG. 7, which facilitates the fixation of the first terminals 12 in the process of injection molding.

In some exemplary embodiments, the first terminals 12 each include a first grounding terminal 12A and a first signal terminal 12B, and the first grounding terminal 12A extends on a front end of the tongue plate 112 and surpasses the first signal terminal 12B in length. The second terminals 13 each include a second grounding terminal 13A and a second signal terminal 13B, and the second grounding terminal 13A extends on the front end of the tongue plate 112 and surpasses the first signal terminal 13B in length.

A plurality of third recesses 1121B is positioned on front ends of the first surface 1121 of the tongue plate 112. A plurality of fourth recesses 1122B is positioned on front ends of the second surface 1122 of the tongue plate 112. The third recesses 1121B and the fourth recesses 1122B are located in front of the first signal terminals 12B and the second signal terminals 13B. The arrangement of the third recesses 1121B and the fourth recesses 1122B shorten the front ends of the first and second signal terminals 12B, 13B, which is favorable to improving the high frequency response of the electrical socket connector 10, and reducing the signal attenuation in the transmission process of high speed signals.

The tongue plate 112 includes first barriers 1121C and second barriers 1122C. Each first barrier 1121C is positioned between two adjacent third recesses 1121B and each second barrier 1122C positioned between two adjacent fourth recesses 1122B. An excess part of each first grounding terminal 12A over a corresponding one of the first signal terminals 12B is fixed on a corresponding one of the first barriers 1121C. Similarly, an excess part of each second grounding terminal 13A over a corresponding one of the second signal terminals 13B is fixed on a corresponding one of the second barriers 1122C.

In some exemplary embodiments, parts of the first grounding terminals 12A fixed on the first barriers 1121C and parts of the second grounding terminals 13A fixed on the second barriers 1122C are mutually staggered; the third recesses 1121B on the first surface 1121 of the tongue plate 112 and the fourth recesses 1122B on the second surface 1122 of the tongue plate 112 are mutually staggered, thus reducing the signal crosstalk in the signal transmission process.

As shown in FIG. 4, the basal part 111 includes a front wall 1111, a rear wall 1112, and two sidewalls 1113, 1114 connecting the front wall 1111 and the rear wall 1112. The tongue plate 112 extends from a front end of the front wall 1111. The front wall 1111, the rear wall 1112 and the two sidewalls 1113, 1114 cooperatively define an accommodation space 1115.

The first connection parts 122 and the second connection parts 132 are partially exposed to the accommodation space 1115. The first welding parts 123 extend out of the rear wall 1112, the second welding parts 133 extend out of the front wall 1111 and are positioned in front of the rear wall 1112, the first welding parts 123 and the second welding parts 133 are in the same plane, and the first welding parts 123 and the second welding parts 133 are all SMT welding legs. Two rows of pins of upper and lower terminals in conventional designs are changed into front and back rows of pins, which is favorable to assembly.

The rear wall 1112 defines a plurality of gaps 1112A and each gap 1112A is located between two adjacent first connection parts 122; likewise, arranging each gap II 12A between two adjacent terminals is favorable to improving the high frequency response of the electrical socket connector 10, and further reducing the signal attenuation in the transmission process of high speed signals.

As shown in FIG. 5, parts of the first connection parts 122, which extend out of the front wall 1111 and are exposed to the accommodation space 1115, and parts of the second connection parts 132, which extend out of the front wall 1111 and are exposed to the accommodation space 1115, are mutually staggered, which facilitates the formation of an accommodation space in the injection molding process, thus ensuring the first welding parts 123 and the second welding parts 133 are in the same plane.

In some exemplary embodiments, the first connection part 122 extends from the first contact part 121 and includes a bending part 1221 and a horizontal part 1222. The bending part 1221 and the horizontal part 1222 are in the same plane as the first contact part 121. The bending part 1221 is partially fixed on the front wall 1111 and partially extends out of the front wall 1111, and the horizontal part 1222 is exposed to the accommodation space 1115.

The metal casing 14 includes an upper wall, a lower wall, and two sidewalls. The two sidewalls respectively extend downward to form at least one welding leg 141, which is configured to fix the electrical socket connector 10 on a printed circuit board; the front ends of the upper wall, the lower wall, and the two sidewalls all turn outward to form flanges 142, which can expediently guide the plug-in connection of an electrical plug connector into the electrical socket connector 10. At least one slot 143 is positioned on the upper wall, and the metal elastic piece in the slot 143 butts against the front wall of the basal part 111, which can effectively prevent the over-insertion of the electrical plug connector 10.

Figure 8:
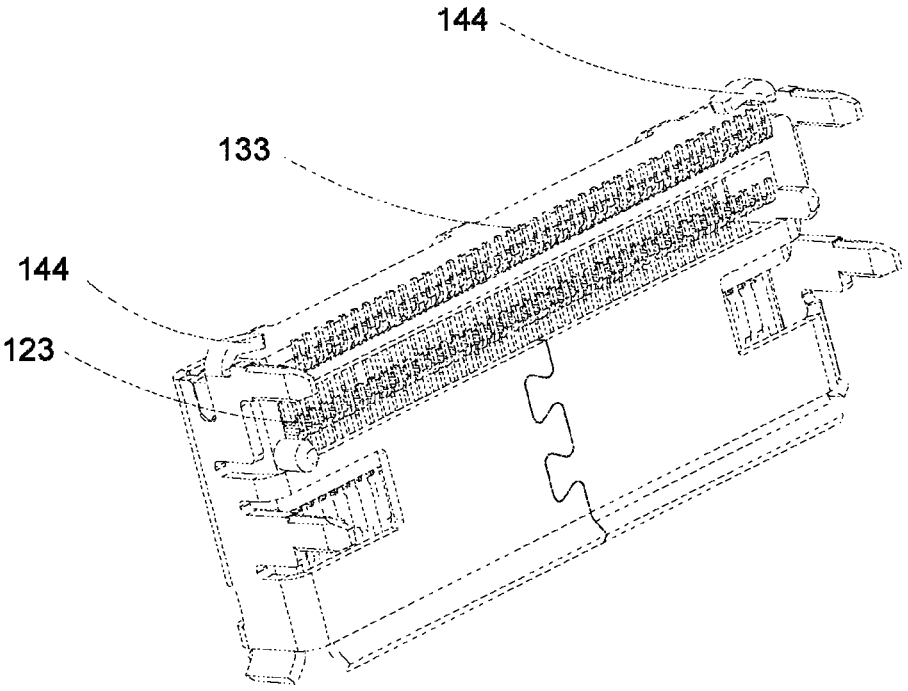
FIG. 8 is a stereogram of the electrical socket connector of FIG. 1, but viewed from another angle.

FIG. 8 is a stereogram of the electrical socket connector 10 in the embodiment of the present disclosure, viewed from another angle. As shown in FIG. 8, the metal casing 14 further includes a metal rear cover, which can enhance the anti-electromagnetic interference performance of the electrical socket connector 10, thus ensuring the stability of the signal transmission. The two sidewalls extend backwards respectively to form fasteners 144; through the two fasteners 144, the metal rear cover and the insulation body 11 are fixed together.

Figure 9:
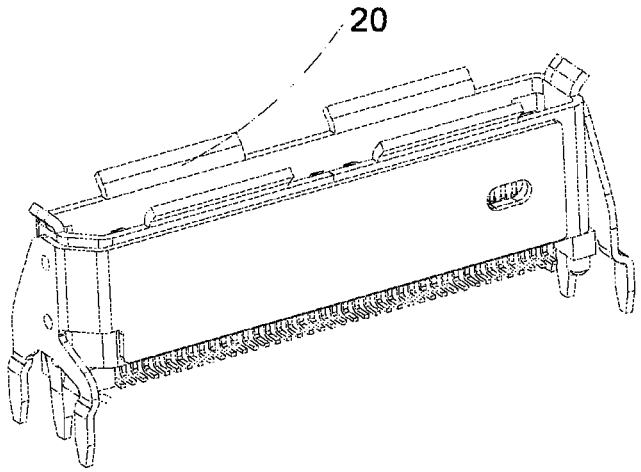
FIG. 9 is a stereogram of an electrical socket connector according to another embodiment of the present disclosure.
Figure 10:
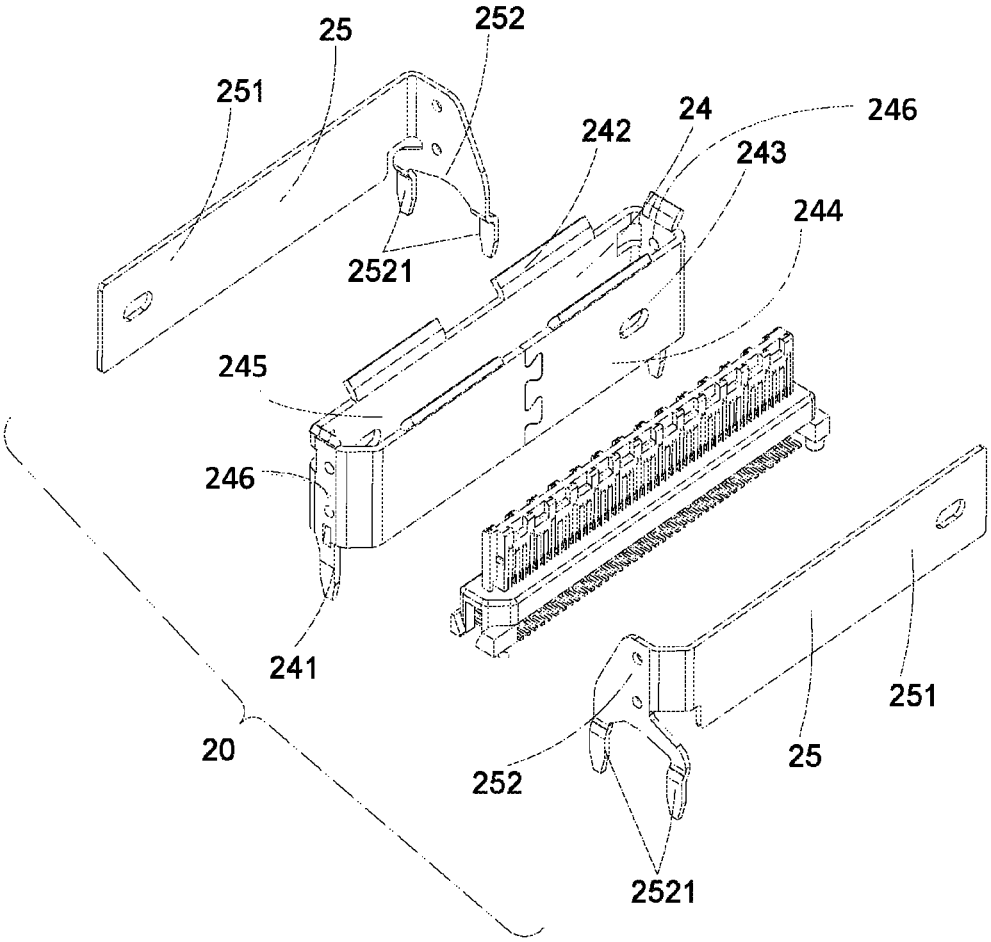
FIG. 10 is an exploded view of the electrical socket connector of FIG. 9.

FIG. 9 is a stereogram of an electrical socket connector according to another embodiment of the present disclosure. Different from the horizontal type electrical socket connector 10 in the abovementioned embodiment, the electrical socket connector 20 illustrated in FIG. 9 is vertical type, and further includes at least one second metal casing fixed on the metal casing. FIG. 10 is an exploded view of the electrical socket connector of FIG. 9. As shown in FIG. 10, the electrical socket connector 20 includes at least one second metal casing 25 fixed on the first metal casing 24, the first metal casing 24 includes a metal front wall 244, a metal rear wall 245 and two metal sidewalls 246, and the two metal sidewalls 246 respectively extend downward to form at least one welding leg 242. The second metal casing 25 includes a flat part 251 and at least one second sidewall 252 extending from the flat part 251 and being tightly attached to the metal sidewalls 246, the second sidewall 252 includes a second weld leg 2521 extending from the second sidewall, and the second metal casing 25 and the first metal casing 24 are fixed using laser welding.

In the embodiment, two second metal casings 25 are employed. The flat part 251 of one second metal casing 25 is tightly attached to the metal rear wall of the first metal casing 24, and the flat part 251 of the other second metal casing 25 is tightly attached to the metal front wall of the first metal casing 24. In other embodiments, one second metal casing 25 is also practicable and includes a flat part 251 tightly attached to the metal rear wall and two second side walls 252 formed by extension of the flat part 251 and tightly attached to the metal sidewalls. Likewise, the second sidewalls 252 include second weld legs 2521 formed by extension of the second sidewalls 252, and the second metal casing 25 and the first metal casing 24 are fixed using laser welding.

The front ends of the metal front wall, the metal rear wall, and the two metal sidewalls all turn outward to form flanges 242, which can expediently guide the plug-in connection of an electrical plug connector into the electrical socket connector 20 in use. At least one slot 243 is positioned on the upper wall, and the metal elastic piece in the slot 243 butts against the front wall of the basal part 111, which can effectively prevent the over-insertion of the electrical plug connector.

Different from the techniques in the prior art, the first contact part 121 of the first terminals 12 of the embodiment of the present disclosure includes a first front contact part 1211 and a first rear contact part 1212, the second contact part 131 includes a second front contact part 1311 and a second rear contact part 1312, the width of the first front contact part 1211 is less than the width of the first rear contact part 1212, and the width of the second rear contact part 1312 is less than the width of the second front contact part 1311; each first recess 1121A is positioned between two adjacent first front contact parts 1211, each second recess 1122A is positioned between two adjacent second rear contact parts 1312, as a result, the electrical socket connector 10, 20 has a compact structure, is easy to manufacture, and can improve the speed and stability of signal transmission and reduce the signal attenuation and crosstalk in high speed signal transmission process.

Finally it shall be noted that, the above embodiments are only used to describe but not to limit the technical solutions of the present disclosure; and within the concept of the present disclosure, technical features of the above embodiments or different embodiments may also be combined with each other, the steps may be implemented in an arbitrary order, and many other variations in different aspects of the present disclosure described above are possible although, for purpose of simplicity, they are not provided in the details. Although the present disclosure has been detailed with reference to the above embodiments, those of ordinary skill in the art shall appreciate that modifications can still be made to the technical solutions disclosed in the above embodiments or equivalent substations may be made to some of the technical features, and the corresponding technical solutions will not depart from the scope of the present disclosure due to such modifications or substations.

What is claimed is:

1. An electrical socket connector, comprising: an insulation body, first terminals, second terminals, and a first metal casing; the insulation body comprising a basal part and a tongue plate connected to the basal part, and the tongue plate comprising a first surface and a second surface opposite to each other, the first terminals each comprising a first contact part, the second terminals each comprising a second contact part, the first contact part being positioned on the first surface of the tongue plate, the second contact part being fixed on the second surface of the tongue plate, and center lines of some of the first contact parts and some of the second contact parts being vertically aligned with each other, wherein, each first contact part comprises a first front contact part and a first rear contact part, each second contact part comprises a second front contact part and a second rear contact part, a width of the first front contact part is less than a width of the first rear contact part, and a width of the second rear contact part is less than a width of the second front contact part;

the tongue plate defines first recesses, each first recess is positioned between two adjacent first front contact parts, and each of the second front contact parts is exposed to two adjacent first recesses; and the tongue plate defines second recesses, each second recess is positioned between two adjacent second rear contact parts, and each of the first rear contact parts is exposed to two adjacent second recesses.

2. The electrical socket connector according to claim 1, wherein, the first terminals each comprise a first grounding terminal and a first signal terminal, and the first grounding terminal extends on a front end of the tongue plate and surpasses the first grounding terminal in length; and the second terminals each comprise a second grounding terminal and a second signal terminal, and the second grounding terminal extends on the front end of the tongue plate and surpasses the second grounding terminal in length.

3. The electrical socket connector according to claim 2, wherein, the tongue plate defines a plurality of third recesses positioned on front ends of the first surface and defines a plurality of fourth recesses positioned on front ends of the second surface; the third recesses are located in front of the first signal terminals, and the fourth recesses are located in front of the second signal terminals.

4. The electrical socket connector according to claim 3, wherein, the tongue plate comprises first barriers positioned, each first barrier is positioned between two adjacent third recesses, the tongue plate comprises second barriers, each second barrier is positioned between two adjacent fourth recesses; an excess part of each first grounding terminal over a corresponding first signal terminal is positioned on a corresponding one of the first barriers, and an excess part of each second grounding terminal over a corresponding second signal terminal is positioned on a corresponding one of the second barriers.

5. The electrical socket connector according to claim 4, wherein, the excess parts of the first grounding terminals positioned on the first barriers and the excess parts of the second grounding terminals positioned on the second barriers are mutually staggered; and the third recesses on the first surface and the fourth recesses on the second surface are mutually staggered.

6. The electrical socket connector according to claim 1, wherein, the first terminals each further comprise a first connection part and a first welding part, the second terminals each further comprise a second connection part and a second welding part, the first connection part and the second connection part are positioned on the basal part, and the first welding part and the second welding part extend out of the insulation body;

the basal part comprises a front wall, a rear wall, and two sidewalls connecting the front wall and the rear wall; the tongue plate extends from a front end of the front wall; the front wall, the rear wall and the two sidewalls cooperatively define an accommodation space; and the first connection part and the second connection part are partially exposed to the accommodation space, the first welding part extends out of the rear wall, the second welding part extends out of the front wall and is positioned in front of the rear wall, the first welding part and the second welding part are in the same plane, and the first welding part and the second welding part are all SMT welding legs.

7. The electrical socket connector according to claim 6, wherein, the rear wall defines a plurality of gaps and each gap is located between two adjacent first connection parts.

8. The electrical socket connector according to claim 6, wherein, part of the first connection part, which extends out of the front wall and is exposed to the accommodation space, and part of the second connection part, which extends out of the front wall and is exposed to the accommodation space, are mutually staggered.

9. The electrical socket connector according to claim 6, wherein, the first connection part comprises a bending part and a horizontal part, the bending part and the horizontal part are both in the same plane as the first contact part; the bending part is partially positioned on the front wall and partially extends out of the front wall, and the horizontal part is exposed to the accommodation space.

10. The electrical socket connector according to claim 1, further comprising:

at least one second metal casing positioned on the first metal casing, the first metal casing comprising two first metal sidewalls, the two first metal sidewalls respectively extending downward to form at least one welding leg, the second metal casing comprising a flat part and at least one second sidewall extending from the flat part and tightly attached to the first metal sidewalls, the at least one second sidewall comprising a second weld leg extending from the second sidewall.

* * * * *